United States Patent [19]

Hara et al.

[11] 4,037,646

[45] July 26, 1977

[54] MOLDS FOR CONTINUOUSLY CASTING STEEL

[75] Inventors: Senri Hara; Tomohiko Kimura, both of Ibaragi; Hiroshi Tomono, Wakayama; Takayuki Sato, Osaka, all of Japan

[73] Assignees: Sumitomo Metal Industries, Ltd.; Satosen Company Limited, both of Osaka, Japan

[21] Appl. No.: 692,909

[22] Filed: June 4, 1976

[30] Foreign Application Priority Data

| | | |
|---|---|---|
| June 13, 1975 | Japan | 50-72170 |
| Oct. 27, 1975 | Japan | 50-129556 |
| Oct. 27, 1975 | Japan | 50-129557 |

[51] Int. Cl.[2] ..... B22C 9/06; B22D 11/00

[52] U.S. Cl. ..... 164/273 R; 164/138; 164/82; 249/116; 427/135

[58] Field of Search ..... 164/82, 273 R, 138, 164/273 R; 249/116; 427/135

[56] References Cited

U.S. PATENT DOCUMENTS

| | | | |
|---|---|---|---|
| 3,204,917 | 9/1965 | Richards | 249/116 |
| 3,339,588 | 9/1967 | Nilles | 249/116 X |
| 3,429,365 | 2/1969 | Schrewe | 164/273 R |

FOREIGN PATENT DOCUMENTS

| | | | |
|---|---|---|---|
| 638,786 | 2/1964 | Belgium | 164/138 |
| 664,575 | 9/1965 | Belgium | 164/138 |
| 28,255 | 4/1973 | Japan | |
| 103,031 | 12/1973 | Japan | |

*Primary Examiner*—Ronald J. Shore
*Attorney, Agent, or Firm*—Armstrong, Nikaido & Marmelstein

[57] ABSTRACT

A copper or copper alloy mold for continuously casting steel is characterized in that the mold has a first layer formed on its interior surface and comprising at least one of nickel and cobalt and a second layer formed on the first layer and containing at least one of nickel and cobalt as a main component and at least one of phosphorus and boron.

14 Claims, 3 Drawing Figures

MOLDS FOR CONTINUOUSLY CASTING STEEL

Figure 1:
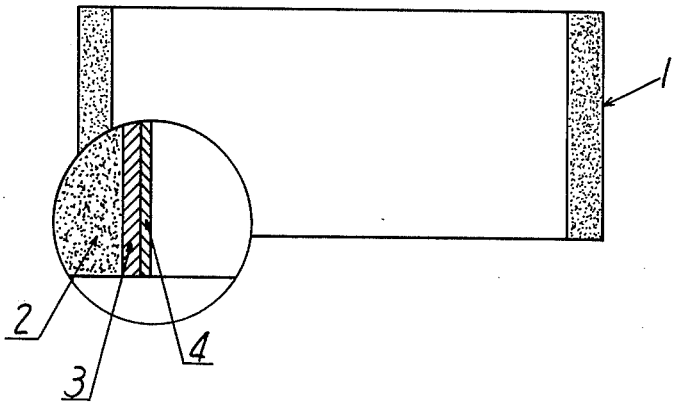

This invention relates to molds for continuously casting steels such as low-carbon steel, high-carbon steel, stainless steel and the like.

Conventionally molds for continuous casting are made of copper or copper alloy having high thermal conductivity and permitting effective cooling with water. However, because the mold receives molten steel of very high temperature, the mold suffers marked damage on its interior surface exposed to the molten steel and becomes unserviceable within a short period of time due to the unsatisfactory physical properties of the copper material at high temperatures, however ingeniously the mold may be cooled from outside.

In order to overcome this drawback, an attempt has been made to form a hard chromium plating over the mold surface to be exposed to the molten steel (hereinafter referred to as "base surface") to give the mold improved heat and abrasion resistance and to interpose a flowing layer of vitreous powder between the chromium-plated mold surface and the flow of molten steel to avoid direct contact of the molten steel with the mold. Although the above-mentioned treatment is effective in increasing the life of the mold to some extent, the mold base surface becomes exposed and seriously damaged within a relatively short period of use owing to the deterioration of the abrasion and corrosion resistance of the hard chromium plating. The exposed surface permits the copper or copper alloy material to adhere to or penetrate into the slab, embrittling the product or creating minute cracks (star cracks) therein.

It has also been proposed to form a nickel coating over the base surface of the mold. For example, Japanese Patent Publication No. 28255/1973 discloses a method in which the base surface of a copper mold is plated with nickel and the coated mold is then heated at about 600° to about 1,00° C in a non-oxidizing atmosphere to form a diffused layer between the nickel plating and the copper. This method provides a tough intimate bond between the nickel layer and the base surface and contemplates a prolonged mold life due to the presence of the heat-resistant nickel layer. However, the nickel layer has fairly low hardness of about 25 to about 400 in terms of microhardness (Vickers hardness, HV) and accordingly low wear resistance, so that the desired extension of life requires an exceedingly thick plating which invariably lowers the cooling efficiency of the mold. With the disclosed method, the nickel-copper diffused layer is formed by heating at a high temperature of about 600° to about 1,000° C, but the heat treatment is liable to blister the nickel layer or distort the mold, impairing the dimensional accuracy of the mold.

Further Japanese Patent Application Disclosure No. 103031/1973 proposes a method in which a mold is electrolessly plated to a thickness of 3 to 300 $\mu$ with nickel containing 3 to 13% of phosphorus and the plated mold is heat-treated at a temperature of up to 400° C. This method intends to prolong the mold life by coating the mold with a nickel-phosphorus alloy having extremely high heat resistance and hardness, but too great a difference between the hardness of the mold base surface (HV 150–250) and that of the nickel-phosphorus alloy layer (HV 900-1, 100) inevitably leads to separation of the nickel-phosphorus layer. A satisfactory mold life is still unavailable, therefore.

Accordingly the main object of this invention is to overcome the foregoing drawbacks of conventional molds for continuously casting steel.

Another object of this invention is to provide molds for continuously casting steel provided with a coating excellent in resistance to heat, abrasion and corrosion and like physical properties at high temperatures.

Still another object of this invention is to provide molds for continuously casting steel which are serviceable over a prolonged period of time, giving slab products free of defects such as star cracks.

Other objects and features of this invention will become apparent from the following description.

This invention provides a copper or copper alloy mold for continuously casting steel characterized in that the mold has a first layer formed on its interior surface and comprising at least one of nickel and cobalt and a second layer formed on the first layer and containing at least one of nickel and cobalt as a main component and at least one of phosphorus and boron.

We have made intensive research to remedy conventional surface-treated molds for continuously casting steel and completed a mold by coating the interior base surface of the mold with an electroplated layer (hereinafter referred to as "first layer") of at least one of nickel and cobalt and further coating the layer with an alloy layer (hereinafter referred to as "second layer") containing at least one of nickel and cobalt as a main component and at least one of phosphorus and boron. We have found that the mold thus prepared without heat-treatment subsequent to the formation of the two layers has an intimate and sufficient bond between the first layer and the mold base surface and that the second layer has been joined intimately to the first layer. When put to practical use, the mold was found serviceable over a greatly extended period of time. Thus this invention has been accomplished based on these findings.

The present mold, surface-treated as above, is remarkably resistant to corrosion, possesses exceedingly high hardness and heat resistance at high temperatures and has an outstanding intimate bond between the first layer and the mold base surface. Because of these properties, the present mold has a surprisingly increased life which is more than 100 times as long as that of the nickel-plated mold referred to above. Further since the mold of this invention does not require any special heat treatment, it is free of the drawbacks resulting from the heat treatment stated. The satisfactory intimate bond between the three layers of the mold base, first layer and second layer of this invention is attributable to the presence of the first layer interposed between the mold base surface having very low hardness and the second layer having high hardness. The first layer serves to reduce the difference in hardness between adjacent layers, giving gradually varying hardnesses to the composite structure. The intimate bond is also attributable to the fact that the first and second layers are deformable in conformity with the plastic deformation of the mold base surface caused by the casting pressure thereon, because the second layer has high heat and abrasion resistance at high temperatures.

Referring to the drawings,

FIG. 1 is a sectional view of a mold 1 of this invention, schematically showing a copper base body 2, a first layer 3 comprising at least one of nickel and cobalt and a second layer 4 comprising at least one of nickel and cobalt as a main component and at least one of phosphorus and boron.

Figure 2:
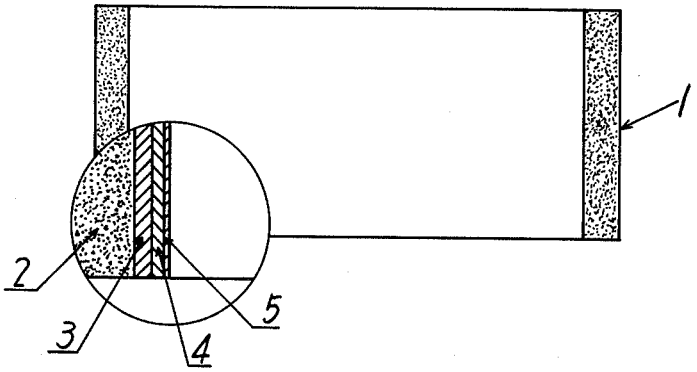

FIG. 2 is a sectional view of another mold 1 of this invention, schematically showing a copper base body 2, a first layer 3 comprising at least one of nickel and cobalt, a second layer 4 comprising at least one of nickel and cobalt as a main component and at least one of phosphorus and boron, and an oxide film 5 formed on the second layer 4.

Figure 3:
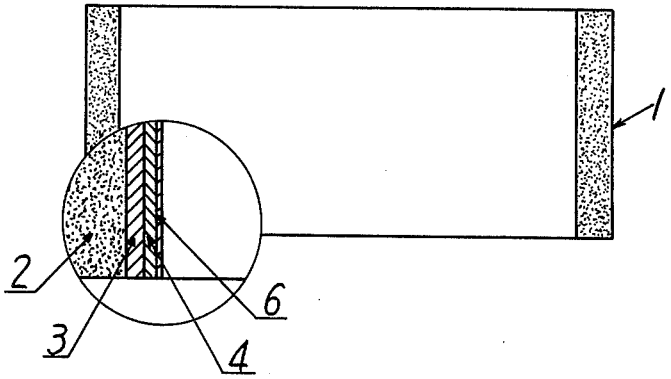

FIG. 3 is a sectional view of still another mold 1 of this invention, schematically showing a copper base body 2, a first layer 3 comprising at least one of nickel and cobalt, a second layer 4 comprising at least one of nickel and cobalt as a main component and at least one of phosphorus and boron and a third layer 6 of chromium formed on the second layer 4.

The nickel and cobalt for forming the first layer on the mold base surface according to this invention may be used singly or conjointly. The first layer can be formed on the base surface of a copper or copper alloy mold by subjecting the surface to usual pretreatment and electroplating the pretreated surface in a usual manner, for example by the following steps: Alkali degreasing→ washing with water→ electrolytic degreasing→ washing with water 43 treatment with acid→ washing with water→ electroplating. The alkali degreasing bath, for example, comprises 20~200 g/l of NaOH, 0~150 g/l of $Na_2CO_3$, 0~100 g/l of sodium orthosilicate and 0.5~30 g/l of surfactant and has a pH of about 10 to about 14. The alkali degreasing is conducted at a temperature of about 20° to about 80° C for about 5 to about 60 minutes. The electrolytic degreasing may be conducted at a cathode current density ($D_K$) of about 1 to about 30 A/dm², at a temperature of about 30 to about 70° C for about 1 to about 30 minutes, using for example the same bath as the alkali degreasing bath. The acid treatment is carried out with about 5 to about 50% solution of HCl, $H_2SO_4$ or like acid at room temperature for about 1 to about 10 minutes. Tables 1 to 3 give examples of baths for nickel plating, cobalt plating and nickel-cobalt plating, respectively.

Table 1

| | I | II | III |
|---|---|---|---|
| Nickel sulfamate | 200–600 g/l | | |
| Nickel chloride | 0–60 g/l | 30–70 g/l | |
| Boric acid | 0–50 g/l | 20–60 g/l | 30–40 g/l |
| Surfactant | 0– 1 g/l | 0– 1 g/l | |
| Stress reducing agent | 0–10 g/l | | |
| Nickel sulfate | | 200–350 g/l | |
| Brightener | | 0–5 cc/l | |
| Nickel boro-fluoride | | | 200–250 g/l |
| Borofluoric acid | | | 10–20 cc/l |
| Anode | Carbonized Ni plate | Ni plate | Ni plate |
| pH | 2.7–5.0 | 4.0–5.0 | 2.0–4.0 |
| Temp. (° C) | 40–60 | 45–50 | 50–55 |
| $D_K$(A/dm²) | 0.5–10 | 1–3 | 5–10 |

Table 2

| | I | II | III | IV | V |
|---|---|---|---|---|---|
| Cobalt sulfate | 200–400 g/l | | | | |
| Cobalt boro-fluoride | | | | 100–300 g/l | |
| Cobalt sulfamate | | | | | 200–600 g/l |
| Ammonium cobalt sulfate | | | 100–300 g/l | | |
| Boric acid | 20–60 g/l | 30–45 g/l | 20–40 g/l | 0–30 g/l | 20–50 g/l |
| Cobalt chloride | 0–60 g/l | 250–500 g/l | | | |
| pH | 3.0–5.0 | 2.3–4.0 | 4–6 | 2–4 | 2–5 |
| Temp. (° C) | 30–60 | 40–80 | 20–50 | 40–60 | 20–60 |
| $D_K$(A/dm²) | 0.5–5 | 0.5–10 | 0.5–4 | 0.5–8 | 0.5–7 |

Table 3

| | I | II | III | IV | V |
|---|---|---|---|---|---|
| Nickel sulfate | 50–300 g/l | | | | |
| Cobalt sulfate | 20–200 g/l | | | | |
| Nickel chloride | | 20–400 g/l | | | 20–120 g/l |
| Cobalt chloride | | 20–400 g/l | | | 5–70 g/l |
| Nickel sulfamate | | | | 50–350 g/l | |
| Cobalt sulfamate | | | | 20–260 g/l | |
| Cobalt boro-fluoride | | | 50–250 g/l | | |
| Nickel boro-fluoride | | | 10–300 g/l | | |
| Potassium pyro-phosphate | | | | | 150–300 g/l |
| Boric acid | 0–50 g/l | 5–50 g/l | 0–50 g/l | 0–40 g/l | |
| pH | 1–5 | 1–5 | 1–5 | 1–4 | 7–12 |
| Temp. (° C) | 30–90 | 20–90 | 30–60 | 30–70 | 30–85 |
| $D_K$(A/dm²) | 0.5–5 | 0.5–7 | 0.5–8 | 0.5–10 | 0.5–5 |

The second layer to be formed over the first layer and containing nickel or cobalt as a main component and phosphorus or boron is excellent in corrosion resistance and has extremely high heat resistance and hardness at high temperatures. The second layer may be formed by electroplating but can be advantageously provided by electroless plating which deposits compact crystals and with which the phosphorus or boron content of the resulting alloy is variable as desired. Table 4 shows examples of electroless plating baths for forming the second layer.

Table 4

| | I | II | III | IV | V | VI |
|---|---|---|---|---|---|---|
| Nickel sulfate | (g/l) 5–50 | | | (g/l) 5–40 | (g/l) 0–40 | (g/l) 0–50 |
| Nickel chloride | 0–20 | | | 0–40 | 5–40 | |
| Cobalt sulfate | | (g/l) 0–10 | | 0–35 | 0–40 | |
| Cobalt chloride | | 5–50 | | 5–35 | 5–40 | |
| Nickel sulfamate | | | (g/l) 0–40 | | | 5–20 |
| Cobalt sulfamate | | | 0–40 | | | 0–10 |
| Sodium citrate | 20–200 | 30–200 | 20–150 | 30–200 | 20–200 | 30–200 |
| Sodium acetate | 0–30 | 0–20 | 0–40 | 0–30 | 0–20 | 0–20 |
| Sodium hypophosphite | 10–30 | 10–30 | 5–30 | 5–30 | 0–30 | 5–30 |
| Sodium borohydride | | | 0–20 | 0–10 | 1–10 | 0–20 |
| Temp.(° C) | 50–100 | 50–100 | 40–98 | 50–98 | 40–98 | 50–98 |
| pH | 3–13 | 2–13 | 3–13 | 3–13 | 3–12 | 3–13 |

The bath may further contain sodium ions for example of sodium hydroxide, in which case the phosphorus content of the deposited alloy increases proportionally with the increase in the concentration of the sodium ions. By virtue of the presence of the alloy layer (second layer) having outstanding heat and abrasion resistance, the first layer provided between the alloy layer and the base mold surface can be intimately held to the surface with high bond strength. The nickel and cobalt may be used singly or conjointly in the second layer. The alloy layer may contain both or either one of phosphorus and boron. The phosphorus content of the alloy, which is suitably determinable, may preferably be in the range of 4 to 20 wt. %, whilst the boron content may preferably be 2 to 15 wt. % based on the alloy. The quantity of the phosphorus or boron contained in the alloy may exceed the above-mentioned range, but lesser amounts will pose problems in respect of heat resistance and hardness. Excess amounts are economically unfavorable.

According to this invention, the thicknesses of the first layer and second layer, which are widely variable with the temperature of molten steel of the type used and dimensions of the mold, may preferably be such that the thickness of the overall composite coating will be about 50 to about 2000$\mu$. The thickness can be outside this range, but too small a thickness permits partial exposure of the rough base mold surface and makes it difficult to ensure the desired mold life, whereas too large an overall thickness requires a prolonged plating time and is practically unnecessary. Generally the second layer may preferably have a thickness of up to about 100$\mu$; it is disadvantageous to form a layer of excessive large thickness because of the low velocity of deposition of the alloy. On the other hand, the thickness of the second layer may preferably be not smaller than about 10$\mu$. Accordingly it is desirable that the first layer have a thickness of about 30 to about 1900$\mu$.

Our research has also revealed that the so-called breakout phenomenon can be effectively prevented to further increase the life of the mold by oxidizing the surface of the second layer to form an oxide film thereon or by providing a chromium plating over the second layer. By the breakout is meant the phenomenon that droplets of molten steel produced upon pouring of molten steel are deposited and solidified on the mold surface, damaging the skin of the slab subsequently formed within the mold. Accordingly the breakout takes place usually when the surface layer of the mold is compatible with the molten steel. Although the second layer of the mold of this invention in the form of an alloy layer of nickel and/or cobalt and phosphorus and/or boron is in itself of such nature that it is less prone to breakout than the interior surface of conventional molds, the surface of the second layer can be rendered almost free of deposition of droplets of molten steel and therefore of the resulting breakout when further oxidized or coated with a third layer of chromium plating.

The oxide film can be formed by known oxidizing methods, among which anodic oxidation or flame oxidation is generally preferable. When the anodic oxidation process is resorted to, the second layer is used as an anode and electrolyzed in an aqueous alkaline solution at room temperature to about 60° C. The aqueous alkaline solution may contains, for example, 50 to 300 g/l of NaOH, 50 to 200 g/l of sodium carbonate or 100 to 300 g/l of potassium hydroxide. The electrolysis is conducted at a current density of about 5 to about 10 A/dm$^2$ and at room temperature to about 60° C for about 5 to about 10 minutes. This treatment oxidizes the surface of the second layer progressively toward its interior, forming an oxide film. The oxide film is satisfactorily serviceable if it has a thickness of at least about 0.001$\mu$. The surface of the second layer can be converted to an oxide film of the above-mentioned thickness also by flame oxidation, for example by heating the surface by a gas burner in the atmosphere.

The chromium plating layer can be readily formed by a usual electroplating process. Examples of chromium plating baths are shown in Table 5.

Table 5

| | I | II |
|---|---|---|
| Chromic acid | 100–300g/l | 100–300g/l |
| Sulfuric acid | 0.5–3 g/l | 0.1–1 g/l |
| Potassium silicofluoride | | 3–10 g/l |
| Temp. (° C) | 20–60 g/l | 20–50 g/l |
| $D_K$ (A/dm$^2$) | 3–70 g/l | 1–30 g/l |

The thickness of the chromium plate layer, although widely variable with the temperature of the molten steel of the type used and the dimensions of the mold, may generally be about 0.1 to about 10 μ. The chromium layer thus provided on the surface of the mold of this invention has fairly low hardness and poor resistance to heat, separation and abrasion, with the result that the chromium layer may be worn away during continuous casting operation, consequently exposing the underlying second layer. However, by the time the second layer becomes exposed, the hot molten steel placed into the mold has already formed on the surface of the second layer an oxide film which is compatible with the molten steel. This film acts in the same manner as the foregoing oxide film to prevent breakout.

This invention will be described below more specifically with reference to Examples.

EXAMPLE 1

The base body of a pure copper mold (300 mm wide × 1,300 mm long × 800 mm high) for continuously casting steel slabs is masked with about 0.5 to about 1 mm thick polyvinyl chloride coating over the entire surface thereof except where it is to be exposed to molten steel, and the mold body is degreased by being immersed at 50 ° C for 40 minutes in an aqueous solution contains 50 g/l of sodium hydroxide, 25 g/l of sodium carbonate and 5 g/l of sodium alkylbenzenesulfonate. The mold body is washed with water and then electrolytically degreased in an aqueous solution containing 30 g/l of sodium hydroxide, 150 g/l of sodium orthosilicate and 10 g/l of sodium alkylbenzenesulfonate at a cathode current density of 10 A/dm² at 60° C for 2 minutes. The degreased mold body is washed with water and then immersed in a 5% aqueous solution of sulfuric acid at room temperature for 10 minutes for activation.

The mold body thus pretreated is washed with water and is thereafter electroplated in a bath containing 500 g/l of nickel sulfamate, 30 g/l of nickel chloride, 10 g/l of boric acid and 3 g/l of sodium naphthalenetrisulfonate as stress reducing agent and having a temperature of 45° C and a pH of 4.8, at a cathode current density of 1 A/dm² for 10 hours, while continuously filtering the bath to form a 120 μ thick nickel plating (first layer) on the mold body.

The plated body is washed with water and immediately thereafter immersed in a bath containing 30 g/l of nickel sulfate, 180 g/l of sodium citrate and 18 g/l of sodium hypophosphite and having a pH of 12 and a temperature of 90° C for 8 hours to form a 23μ thick nickel-phosphorus alloy layer (second layer) comprising 88 % of nickel and 12 % of phosphorus. The resulting body is washed with wate and dried, and the polyvinyl chloride mask is removed by the hand in hot water.

The coated surface of the mold thus prepared has a microharndess of 950 (Vickers hardness, HV). With use of the mold, 420 charges of ordinary steel slabs are produced free of any defect.

EXAMPLE 2

The base body of a mold (200 mm wide × 700 mm high × 1,300 mm long) for continuously casting stainless steel slabs made of copper alloy containing up to 1 % of chromium is pretreated in the same manner as in Example 1 and thereafter washed with water. The mold body is then electroplated in a bath containing 260 g/l of cobalt chloride and 30 g/l of boric acid and having a pH of 4.5 and a temperature of 70° C, at a cathode current density of 1 A/dm² for 15 hours to form a 170μ thick cobalt plating (first layer) on the body.

The plated body is washed with water and immediately thereafter immersed in a bath containing 30 g/l of nickel sulfate, 140 g/l of sodium citrate and 15 g/l of sodium hypophosphite and having a pH of 10 and a temperature of 90° C for 10 hours to form a 30μ thick nickel-phosphorus alloy layer (second layer) containing 93 % of nickel and 7 % of phosphorus.

The coated surface of the mold thus prepared has a microhardness of 990 to 1,050 (HV). With use of the mold, 300 charges of stainless steel slabs are produced free of any defect.

EXAMPLE 3

The same mold body as used in Example 1 is pretreated in the same manner as in Example 1 and thereafter washed with water. The mold body is then electroplated in a bath containing 300 g/l of cobalt chloride, 40 g/l of nickel chloride and 20 g/l of boric acid and having a pH of 4.5 and a temperature of 82° C, at a cathode current density of 1 A/dm² for 10 hours to form on the base body a 130μ thick nickel-cobalt alloy layer (first layer) containing 15 % of nickel and 85 % of cobalt.

Subsequently the plated body is imersed in a bath containing 28 g/l of nickel chloride, 30 g/l of sodium citrate and 3 g/l of sodium hydrogenborate and having a pH of 9 and a temperature 85° C for 7 hours to coat the body with a 32μ thick nickel-boron alloy layer (second layer) containing 97 % of nickel and 3 % of boron.

The coated surface of the resulting mold has a microhardness of 500 to 600 (HV). With use of the mold, 350 charges of slabs are produced free of any defect.

EXAMPLE 4

Exactly the same procedure as in Example 1 is repeated except that the electroplating is conducted for 18 hours to increase the thickness of the first layer, whereby the surface of the mold body to be exposed to molten steel is formed with a 200μ thick nickel plating (first layer) and a 23μ thick nickel-phosphorus alloy layer (second layer).

Subsequently the coated body is subjected to electrolysis in an aqueous solution containing 100 g/l of sodium hydroxide at an anode current density of 10 to 20 A/dm² and at room temperature for 10 minutes, using the nickel-phosphorus alloy layer as an anode to form a 0.1μ thick oxide film on the surface of the alloy. The body is washed with water and dried, and the polyvinyl chloride mask is removed.

With use of the mold thus prepared, 420 charges of slabs are produced free of any breakout and other defects.

EXAMPLE 5

Exactly the same procedure as in Example 1 is repeated except that the electroplating is conducted for 18 hours to increase the thickness of the first layer, whereby the surface of the mold body to be exposed to molten steel is formed with a 200μ thick nickel plating (first layer) and a 23μ thick nickel-phosphorus alloy layer (second layer).

Subsequently the coated body is electroplated in a bath containing 300 g/l of chromic acid, 0.8 g/l of sulfuric acid and 5 g/l of potassium silicofluoride at a bath temperature of 40° to 50° C and at a cathode current density of 30 A/dm² for 30 minutes to form a 5μ thick chromium film. The body is then washed with water and dried, and the polyvinyl chloride mask is removed.

With use of the mold thus obtained, 670 charges of ordinary steel slabs are produced free of any breakout and other defects.

EXAMPLE 6

The base body of a pure copper mold (320 mm wide × 700 mm high × 1,500 mm long) for continuously casting steel slabs is masked with about 0.5 to about 1 mm thick polyvinyl chloride coating over the entire surface thereof except where it is to be exposed to molten steel, and the mold body is degreased by being immersed in an aqueous solution at 50° C for 40 minutes. The degreasing solution contains 50 g/l of sodium hydroxide, 25 g/l of sodium carbonate and 5 g/l of sodium alkylbenzenesulfonate. The mold body is washed with water and then electrolytically degreased in an aqueous solution containing 30 g/l of sodium hydroxide, 150 g/l of sodium orthosilicate and 10 g/l of surfactant at a cathode current density of 10 A/dm$^2$ at 60° for 2 minutes. The degreased mold body is washed with water and then immersed in a 5 % aqueous solution of sulfuric acid at room temperature for 10 minutes for activation.

The mold body thus pretreated is washed with water and is thereafter electroplated in a bath containing 320 g/l of nickel sulfate, 30 g/l of nickel chloride, 10 g/l of boric acid and 3 g/l of sodium naphthalenetrisulfonate and having a temperature of 55° C and a pH of 4.5, at a cathode current density of 2 A/dm$^2$ for 12 hours, while continuously filtering the bath to form a 210$\mu$ thick nickel plating (first layer) on the mold body.

The plated body is washed with water and immediately thereafter immersed in a bath containing 30 g/l of nickel chloride, 15 g/l of cobalt sulfate, 10 g/l of sodium hypophosphite, 5 g/l of sodium hydrogenborate and 65 g/l of sodium citrate and having a pH of 10 and a temperature of 72° C for 9 hours to form a 23$\mu$ thick alloy layer of 84 % Ni, 11 Co, 3 % P and 2 % B. The resulting body is washed with water and dried, and the polyvinyl chloride mask is removed by the hand in hot water.

The coated surface of the mold thus prepared has a microhardness of 890 (Vickers hardness, HV). With use of the mold, 450 charges of ordinary steel slabs are produced free of any defect.

EXAMPLE 7

The base body of a pure copper mold (290 mm wide × 700 mm high × 1,200 mm long) for continuously casting steel slabs is masked with about 0.5 to about 1 mm thick polyvinyl chloride coating over the entire surface thereof except where it is to be exposed to molten steel, and the mold body is degreased by being immersed in an aqueous solution at 50° C for 40 minutes. The degreasing solution contains 50 g/l of sodium hydroxide, 25 g/l of sodium carbonate and 5 g/l of sodium alkylbenzenesulfonate. The mold body is washed with water and then electrolytically degreased in an aqueous solution containing 30 g/l of sodium hydroxide, 150 g/l of sodium orthosilicate and 10 g/l of surfactant at a cathode current density of 10 A/dm$^2$ at 60° C for 2 minutes. The degreased mold body is washed with water and then immersed in a 5 % aqueous solution of sulfuric acid at room temperature for 10 minutes for activation.

The mold body thus pretreated is washed with water and is thereafter electroplated in a bath containing 450 g/l of nickel sulfamate, 30 g/l of nickel chloride, 10 g/l of boric acid and 3 g/l of sodium naphthalenetrisulfonate and having a temperature of 50° C and a pH of 3.0, at a cathode current density of 5 A/dm$^2$ for 20 hours, while continuously filtering the bath to form a 1,100$\mu$ thick nickel plating (first layer) on the mold body.

The plated body is washed with water and immediately thereafter imersed in a bath containing 40 g/l of cobalt sulfate, 40 g/l of sodium citrate and 7 g/l of sodium hydrogenborate and having a pH of 9.8 and a temperature of 92° C for 8.5 hours to form a 50$\mu$ thick cobalt-boron alloy layer (second layer) comprising 98% of cobalt and 2% of boron. The resulting body is washed with water and dried, and the polyvinyl chloride mask is removed by the hand in hot water.

The coated surface of the mold thus prepared has a microhardness of 910 (Vickers hardness, HV). With use of the mold, 920 charges of ordinary steel slabs are produced free of any defect.

EXAMPLE 8

The base body of a pure copper mold (305 mm wide × 700 mm high × 1,600 mm long) for continuously casting steel slabs is masked with about 0.5 to about 1 mm thick polyvinyl chloride coating over the entire surface thereof except where it is to be exposed to molten steel, and the mold body is degreased by being immersed in an aqueous solution at 50° C for 40 minutes. The degreasing solution contains 50 g/l of sodium hydroxide, 25 g/l of sodium carbonate and 5 g/l of anionic surfactant. The mold body is washed with water and then electrolytically degreased in an aqueous solution containing 30 g/l of sodium hydroxide, 150 g/l of sodium orthosilicate and 10 g/l of surfactant at a cathode current density of 10 A/dm$^2$ at 60° C for 2 minutes. The degreased mold body is washed with water and then immersed in a 5 % aqueous solution of sulfuric acid at room temperature for 10 minutes for activation.

The mold body thus pretreated is washed with water and is thereafter electroplated in a bath containing 600 g/l of nickel sulfamate, 30 g/l of nickel chloride, 10 g/l of boric acid and 3 g/l of sodium naphthalenetrisulfonate and having a temperature of 48° C and a pH of 4.5, at a cathode current density of 2 A/dm$^2$ for 10 hours, while continuously filtering the bath to form a 240$\mu$ thick nickel plating (first layer) on the mold body.

The plated body is washed with water and immediately thereafter immersed in a bath containing 34 g/l of nickel sulfate, 29 g/l of sodium citrate and 40 g/l of sodium succinate, 4 g/l of lactic acid and 8 g/l of sodium hydrogen borate and having a pH of 7.5 and a temperature of 85° C for 12 hours to form a 43$\mu$ thick nickel-boron alloy layer (second layer) comprising a 88% of nickel and 12% of phosphorus. The resulting body is washed with water and dried, and the polyvinyl chloride mask is removed by the hand in hot water.

The coated surface of the mold thus prepared has a microhardness of 905 (Vickers hardness, HV). With use of the mold, 440 charges of ordinary steel slabs are produced free of any defect.

EXAMPLE 9

The base body of a mold (300 mm wide by 700 mm high, 1,400 mm long by 700 mm high) for continuously casting steel slabs made of copper is pretreated in the same manner as in Example 1 and thereafter washed with water. The mold body is then electroplated in a bath containing 470 g/l of cobalt sulfamate and 30 g/l of boric acid and having a pH of 2.5 and a temperature of 46° C, at a cathode current density of 4 A/dm² for 14 hours to form a 570μ thick cobalt plating (first layer) on the body.

The plated body is washed with water and immediately thereafter immersed in a bath containing 25 g/l of nickel chloride, 40 g/l of sodium citrate, 15 g/l of Rochelle salt, 5 g/l of succinic acid, 10 g/l of sodium hypophosphite and 8 g/l of sodium hydrogenborate and having a pH of 8.0 and a temperature of 94° C for 7 hours to form a 15μ thick alloy layer (second layer) or 89% Ni, 7% P and 4% B.

The coated surface of the mold thus prepared has a microhardness of 930 (HV). With use of the mold, 340 charges of ordinary steel slabs are produced free of any defect.

EXAMPLE 10

The base body of a mold (280 mm wide by 700 mm high, 1,000 mm long by 700 mm high) for continuously casting steel slabs made of copper alloy containing up to 1 % of silver is pretreated in the same manner as in Example 1 and thereafter washed with water. The mold body is then electroplated in a bath containing 340 g/l of cobalt chloride and 30 g/l of boric acid and having a pH of 5.0 and a temperature of 65° C, at a cathode current density of 2 A/dm² for 10 hours to form a 200μ thick cobalt plating (first layer) on the body.

The plated body is washed with water and immediately thereafter immersed in a bath containing 40 g/l of cobalt chloride, 15 cc/l of ethylenediamine, 10 g/l of sodium citrate, 15 g/l of sodium hypophosphite and 3 g/l of sodium hydrogenborate and having a pH of 12.0 and a temperature of 74° C for 10 hours to form a 37μ thick alloy layer (second layer) of 86% Co, 9% P and 5% B.

The coated surface of the mold thus prepared has a microhardness of 945 (HV). With use of the mold, 520 charges of ordinary steel slabs are produced free of any defect.

EXAMPLE 11

The base body of a mold (400 mm wide by 700 mm high, 1,500 mm long by 700 mm high) for continuously casting steel slabs made of copper is pretreated in the same manner as in Example 1 and thereafter washed with water. The mold body is then electroplated in a bath containing 540 g/l of cobalt sulfamate and 30 g/l of boric acid and having a pH of 3.1 and a temperature of 48° C, at a cathode current density of 5 A/dm² for 10 hours to form a 503μ thick cobalt plating (first layer) on the body.

The plated body is washed with water and immediately thereafter immersed in a bath containing 20 g/l of nickel sulfate, 10 g/l of cobalt chloride, 60 g/l of sodium citrate and 20 g/l of sodium hypophosphite and having a pH of 4.0 and a temperature of 89° C for 20 hours to form a 67μ thick alloy layer (second layer) of 62% Ni, 26% of Co and 12% of P.

The coated surface of the mold thus prepared has a microhardness of 900 (HV). With use of the mold, 690 charges of ordinary steel slabs are produced free of any defect.

EXAMPLE 12

The same mold body as used in Example 1 is pretreated in the same manner as in Example 1 and thereafter washed with water. The mold body is then electroplated in a bath containing 320 g/l of cobalt sulfamate, 340 g/l of nickel sulfamate and 20 g/l of boric acid and having a pH of 3.7 and a temperature of 55° C, at a cathode current density of 5 A/dm² for 7 hours to form on the base body of 350 μ thick nickel-cobalt alloy layer (first layer) containing 76% of nickel of 24% of cobalt.

Subsequently the plated body is immersed in a bath containing 30 g/l nickel chloride, 10 g/l of cobalt chloride, 80 g/l sodium citrate and 20 g/l of sodium hypophosphite and having a pH of 4.3 and a temperature of 96° C for 3 hours to coat the body with a 30 μ thick alloy layer (second layer) of 87% Ni, 10% Co and 3% P.

The coated surface of the resulting mold has a microhardness of 970 (HV). With use of the mold, 670 charges of slabs are produced free of any defect.

EXAMPLE 13

The same mold body as used in Example 1 is pretreated in the same manner as in Example 1 and thereafter washed with water. The mold body is then electroplated in a bath containing 300 g/l of cobalt sulfamate, 400 g/l of nickel sulfamate and 20 g/l of boric acid and having a pH of 2.9 and a temperature of 45° C, at a cathode current density of 1 A/dm² for 90 hours to form on the base body of 930 μ thick nickel-cobalt alloy layer (first layer) containing 87% of nickel and 13% of cobalt.

Subsequently the plated body is immersed in a bath containing 35 g/l of cobalt chloride, 40 cc/l of ethylenediamine, 7 g/l of sodium hydrogenborate and 10 g/l of sodium hypophosphite and having a pH of 13 and a temperature of 67° C for 10 hours to coat the body with a 47 μ thick alloy layer (second layer) of 88% Co, 9% of P and 3% of B.

The coated surface of the resulting mold has a microhardness of 1,020 (HV). With use of the mole, 880 charges of slabs are produced free of any defect.

EXAMPLE 14

The same mold body as used in Example 1 is pretreated in the same manner as in Example 1 and thereafter washed with water. The mold body is then electroplated in a bath containing 250 g/l of cobalt chloride, 100 g/l of nickel sulfate and 20 g/l of boric acid and having a pH of 2.0 and a temperature of 90° C, at a cathode current density of 5 A/dm² for 7 hours to form on the base body a 352 μ thick nickel-cobalt alloy layer (first layer) containing 36% of nickel and 64% of cobalt. Subsequently the plated body is immersed in a bath containing 32 g/l of nickel chloride, 25 g/l of sodium citrate, 10 g/l of succinic acid, 10 cc/l of lactic acid and 20 g/l of hypophophorous acid and having a pH of 4.5 and a temperature of 94° C for 5 hours to coat the body with a 85μ thick alloy layer (second layer) of 91% Ni and 9% P.

The coated surface of the resulting mold has a microhardness of 960 (HV). With use of the mold, 490 charges of slabs are produced free of any defect.

EXAMPLE 15

Exactly the same procedure as in Example 7 is repeated except that the electroplating is conducted for 18 hours to increase the thickness of the first layer, whereby the surface of the mold body to be exposed to molten steel is formed with a 1,000μ thick nickel plating (first layer) and a 50μ thick cobalt-phosphorus alloy layer (second layer).

Subsequently the coated body is subjected to electrolysis in an aqueous solution containing 200 g/l of sodium hydroxide at an anode current density of 5 A/dm² and at room temperature for 50 minutes, using the alloy layer as an anode to form a 0.5μ thick oxide film on the surface of the alloy. The body is washed with water and dried, and the polyvinyl chloride mask is removed.

With use of the mold thus prepared, 1,200 charges of slabs are produced free of any breakout and other defects.

EXAMPLE 16

Exactly the same procedure as in Example 10 is repeated except that the electroplating is conducted for 20 hours to increase the thickness of the first layer, whereby the surface of the mold body to be exposed to molten steel is formed with a 370 μ thick cobalt plating (first layer) and a 37 μ thick CO—P—B alloy layer (second layer).

Subsequently the coated body is subjected to electrolysis in an aqueous solution containing 150 g/l of sodium hydroxide at an anode current density of 20 A/dm² and at room temperature for 20 minutes, using the alloy layer as an anode to form a 0.7 μ thick oxide film on the surface of the alloy. The body is washed with water and dried, and the polyvinyl chloride mask is removed.

With use of the mold thus prepared, 510 charges of slabs are produced free of any breakout and other defects.

EXAMPLE 17

Exactly the same procedure as in Example 12 is repeated except that the electroplating is conducted for 8 hours to increase the thickness of the first layer, whereby the surface of the mold body to be exposed to molten steel is formed with a 400 μ thick Ni—Co plating (first layer) and a 30 μ thick Ni—Co—P alloy layer (second layer).

Subsequently the coated body is subjected to electrolysis in an aqueous solution containing 300 g/l of soidum hydroxide at an anode current density of 20 A/dm² and at room temperature for 10 minutes, using the alloy layer as an anode to form a 0.2 μ thick oxide film on the surface of the alloy. The body is washed with water and dried, and the polyvinyl chloride mask is removed.

With use of the mold thus prepared, 660 charges of slabs are produced free of any breakout and other defects.

EXAMPLE 18

Exactly the same procedure as in Example 6 is repeated except that the electroplating is conducted for a different period of time to alter the thickness of the first layer, whereby the surface of the mold body to be exposed to molten steel is formed with a 220 μ thick nickel plating (first layer) and a 32 μ thick Ni—Co—P—B alloy layer (second layer).

Subsequently the coated body is electroplated in a bath containing 250 g/l of chromic acid and 2.5 g/l of sulfuric acid at a bath temperature of 40° to 50° C and at a cathode current density of 35 A/dm² for 20 mintues to form a 4 μ thick chromium film. The body is then washed with water and dried, and the polyvinyl chloride mask is removed.

With use of the mold thus obtained, 520 charges of ordinary steel slabs are produced free of any breakout and other defects.

EXAMPLE 19

Exactly the same procedure as in Example 10 is repeated except that the electroplating is conducted for a different period of time to alter the thickness of the first layer, whereby the surface of the mold body to be exposed to molten steel is formed with a 230 μ thick cobalt plating (first layer) and a 37 μ thick Co—P—B alloy layer (second layer).

Subsequently the coated body is electroplated in a bath containing 350 g/l of chromic anhydride and 1.8 g/l of sulfuric acid at a bath temperature of 40° to 50° C and at a cathode current density of 20 A/dm² for 60 minutes to form a 10 μ thick chromium film. The body is then washed with water and dried, and the polyvinyl chloride mask is removed.

With use of the mold thus obtained, 595 charges of ordinary steel slabs are produced free of any breakout and other defects.

EXAMPLE 20

Exactly the same procedure as in Example 13 is repeated except that the electroplating is conducted for a different period of time to alter the thickness of the first layer, whereby the surface of the mold body to be exposed to molten steel is formed with a 500 μ thick Ni—Co plating (first layer) and a 47 μ thick Co—P—B alloy layer (second layer).

Subsequently the coated body is electroplated in a bath containing 200 g/l of chromic anhydride and 1 g/l of sulfuric acid at a bath temperature of 40° to 50° C and at a cathode current density of 10 A/dm² for 10 minutes to form a 1 μ thick chromium film. The body is then washed with water and dried, and the polyvinyl chloride mask is removed.

With use of the mold thus obtained, 820 charges of ordinary steel slabs are produced free of any breakout and other defects.

What we claim is:

1. A copper or copper alloy mold for continuously casting steel characterized in that the mold has a first layer formed on its interior surface and consisting essentially of at least one of nickel and cobalt and a second layer formed on the first layer and consisting essentially of at least one of nickel and cobalt as a main component and at least one of phosphorus and boron.

2. The copper or copper alloy mold for continuously casting steel according to claim 1 in which the first layer has a thickness of about 30 to about 1900 μ and the second layer has a thickness of about 10 to about 100 μ, the total thickness of the first and the second layers being about 50 to 2000 μ.

3. The copper or copper alloy mold for continuously casting steel according to claim 1 in which the phosphorus content in the second layer is in the range of 4 to 20 wt.% based on the weight of the second layer.

4. The copper or copper alloy mold for continuously casting steel according to claim 1 in which the boron content in the second layer is in the range of 2 to 15 wt.% based on the weight of the second layer.

5. A copper or copper alloy mold for continuously casting steel characterized in that the mold has a first layer formed on its interior surface and consisting essentially of at least one of nickel and cobalt and a second layer formed on the first layer and consisting essentialy of at least one of nickel and cobalt as a main component and at least one of phosphorus and boron, the second layer including an oxide film defining the surface thereof.

6. The copper or copper alloy mold for continuously casting steel according to claim 5 in which the first layer has a thickness of about 30 to about 1900 μ and the second layer has a thickness of about 10 to about 100 μ, the total thickness of the first and the second layers being about 50 to 2000μ.

7. The copper or copper alloy mold for continuously casting steel according to claim 5 in which the phosphorus content in the second layer is in the range of 4 to 20 wt.% based on the weight of the second layer.

8. The copper or copper alloy mold for continuously casting steel according to claim 5 in which the boron content in the second layer is in the range of 2 to 15 wt.% based on the weight of the second layer.

9. The copper or copper alloy mold for continuously casting steel according to claim 5 in which the oxide film has a thickness of at least about 0.001 μ.

10. A copper or copper alloy mold for continuously casting steel characterized in that the mold has a first layer formed on its interior surface and consisting essentially of at least one of nickel and cobalt, a second layer formed on the first layer and consisting essentially of at least one of nickel and cobalt as a main component and at least one of phosphorus and boron and a third layer of chromium formed on the second layer.

11. The copper or copper alloy mold for continuously casting steel according to claim 10 in which the first layer has a thickness of about 30 to about 1900 μ and the second layer has a thickness of about 10 to about 100 μ, the total thickness of the first and the second layers being about 50 to 2000 μ.

12. The copper or copper alloy mold for continuously casting steel according to claim 10 in which the phosphorus content in the second layer is in the range of 4 to 20 wt.% based on the weight of the second layer.

13. The copper or copper alloy mold for continuously casting steel according to claim 10 in which the boron content in the second layer is in the range of 2 to 15 wt.% based on the weight of the second layer.

14. The copper or copper alloy mold for continuously casting steel according to claim 10 in which the chromium layer has a thickness of about 0.1 to about 10 μ.

* * * * *